US007833627B1

(12) United States Patent
Ferrando

(10) Patent No.: US 7,833,627 B1
(45) Date of Patent: Nov. 16, 2010

(54) COMPOSITE ARMOR HAVING A LAYERED METALLIC MATRIX AND DUALLY EMBEDDED CERAMIC ELEMENTS

(75) Inventor: William A. Ferrando, Arlington, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 309 days.

(21) Appl. No.: 12/082,192

(22) Filed: Mar. 27, 2008

(51) Int. Cl.
*F41H 5/04* (2006.01)

(52) U.S. Cl. ..... 428/416; 428/911; 89/36.02

(58) Field of Classification Search ..... 428/614, 428/911; 89/36.02
See application file for complete search history.

(56) References Cited

U.S. PATENT DOCUMENTS

| | | | | |
|---|---|---|---|---|
| 3,523,057 | A * | 8/1970 | Buck | 428/156 |
| 4,534,266 | A | 8/1985 | Huet | |
| 4,965,139 | A | 10/1990 | Kabacoff et al. | |
| 4,978,054 | A | 12/1990 | Ferrando et al. | |
| 4,988,673 | A | 1/1991 | Ferrando | |
| 5,051,307 | A | 9/1991 | Divecha et al. | |
| 5,082,826 | A | 1/1992 | Ferrando | |
| 5,091,362 | A | 2/1992 | Ferrando | |
| 5,120,575 | A | 6/1992 | Ferrando et al. | |
| 5,205,996 | A | 4/1993 | Ferrando et al. | |
| 5,214,234 | A | 5/1993 | Divecha et al. | |
| 5,253,797 | A | 10/1993 | Ferrando et al. | |
| 5,295,528 | A | 3/1994 | Diyecha et al. | |
| 5,337,803 | A | 8/1994 | Divecha et al. | |
| 5,361,678 | A | 11/1994 | Roopchand et al. | |

(Continued)

FOREIGN PATENT DOCUMENTS

DE 4125100 A1 * 2/1993

(Continued)

OTHER PUBLICATIONS

U.S. Appl. No. 60/998,459, filed Oct. 5, 2007, invention title "Ballistic Armor Methods, System and Materials," by Curtis A. Martin, Gilbert F. Lee, Jeffrey J. Fedderly, David E. Johnson, David P. Owen, Rodney O. Peterson, Philip J. Dudt, James A. Zaykoski, and Inna G. Talmy.

(Continued)

*Primary Examiner*—Aaron Austin
(74) *Attorney, Agent, or Firm*—Howard Kaiser

(57) ABSTRACT

According to typical inventive practice, a first metallic material is poured into a mold including a bottom inside surface having regularly arrayed rises (truncated spherical convexities). The molten first metallic material cools and solidifies to include a surface correspondingly having regularly arrayed dents (truncated spherical concavities). The resultant "inner casting" is removed from and repositioned in the mold so that the inner casting's dent-laden surface faces upward. Ceramic spheres are placed in the dents. A second metallic material (having a higher melting point than the first metallic material) is poured into the mold with the inner casting and spheres in place. The molten second metallic material cools and solidifies as an "outer casting" surrounding the inner casting and the spheres. The resultant integral armor structure includes the inner casting, the outer casting, and the spheres, each sphere embedded partially in the inner casting and partially in the outer casting.

10 Claims, 11 Drawing Sheets

U.S. PATENT DOCUMENTS

| | | | | |
|---|---|---|---|---|
| 5,421,087 | A | 6/1995 | Newkirk et al. | |
| 5,509,459 | A | 4/1996 | Divecha et al. | |
| 5,804,757 | A * | 9/1998 | Wynne | 89/36.05 |
| 5,858,460 | A | 1/1999 | Ferrando et al. | |
| 6,112,635 | A * | 9/2000 | Cohen | 89/36.02 |
| 6,116,328 | A | 9/2000 | Karmarkar et al. | |
| 6,129,135 | A | 10/2000 | Divecha et al. | |
| 6,386,131 | B1 | 5/2002 | Barsoum | |
| 6,609,452 | B1 * | 8/2003 | McCormick et al. | 89/36.01 |
| 6,679,157 | B2 | 1/2004 | Chu | |
| 6,895,851 | B1 | 5/2005 | Adams et al. | |
| 6,912,944 | B2 * | 7/2005 | Lucuta et al. | 89/36.02 |
| 6,955,112 | B1 | 10/2005 | Adams et al. | |
| 7,025,112 | B1 | 4/2006 | Ferrando | |
| 7,026,045 | B2 | 4/2006 | Rettenbacher et al. | |
| 7,114,764 | B1 | 10/2006 | Barsoum et al. | |
| 7,300,893 | B2 | 11/2007 | Barsoum et al. | |
| 7,685,922 | B1 | 3/2010 | Martin et al. | |
| 2004/0020353 | A1 * | 2/2004 | Ravid et al. | 89/36.02 |
| 2007/0093158 | A1 | 4/2007 | Dudt et al. | |
| 2007/0111621 | A1 | 5/2007 | Barsoum et al. | |

FOREIGN PATENT DOCUMENTS

| | | | |
|---|---|---|---|
| FR | 2559254 | A1 * | 8/1985 |

OTHER PUBLICATIONS

Co-pending U.S. Appl. No. 12/731,675, filed Mar. 25, 2010, entitled "Composite Armor Including Geometric Cermaic Elements for Attenuating Shock Waves," joint inventors Curtis A. Martin, Gilbert F. Lee, and Jeffrey J. Fedderly.

Co-pending U.S. Appl. No. 12/545,095, filed Aug. 21, 2009, entitled "Aluminum Engine Cylinder Liner and Method," joint inventors William A. Ferrando and Catherine R. Wong.

Co-pending U.S. Appl. No. 12/082,190, filed Mar. 31, 2008, entitled "Electrically Assisted Friction Stir Welding," sole inventor William A. Ferrando.

Ferrando et al. U.S. Statuory Invention Registration H1358 publication date Sep. 6, 1994.

* cited by examiner

COMPOSITE ARMOR HAVING A LAYERED METALLIC MATRIX AND DUALLY EMBEDDED CERAMIC ELEMENTS

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

The present invention relates to ballistic armor systems, more particularly to composite ballistic armor systems that include a metallic matrix and one or more metallic or non-metallic elements contained therein.

Military armor applications include land, air and sea vehicles, stationary structures, and personnel. The need for lighter weight and more effective armor plating for protecting various military vehicles is ongoing, especially as enemy munitions become increasingly powerful. Protection of the vehicles and their occupants is needed against impact by a projectile such as a ballistic body (e.g., small arms fire) or an explosive fragment (e.g., shrapnel from a bomb blast). Conventional metal vehicle armor systems basically consist of metal alloy plates, principally steel. These conventional armor systems are becoming prohibitively heavy in order to protect vehicles from increasingly formidable attack capabilities.

A metal matrix composite (MMC) material is a composite material having a metallic matrix and one or more elements, metallic or non-metallic, contained in the metallic matrix. One approach that has been considered for constructing an armor system that is both strong and lightweight involves the utilization of one or more hard solid elements and a relatively lightweight metallic material (elemental metal or metal alloy) as a matrix material for containing the elements. Generally speaking, according to the theory of operation of a metal matrix composite armor system, an element or elements contained in a metallic matrix serve to absorb the energy of an impinging projectile by dissipating the energy into a volume surrounding the penetration point.

For instance, hard spheres (e.g., ceramic spheres of uniform size) have been considered for embedment within a lightweight metal such as an aluminum alloy. For optimal efficiency of energy dissipation of an impinging projectile, the embedded spheres should be arranged in a regular array so that the spheres are not in contact with each other, and so that there is a good bond between the spheres and the metal matrix. Fabrication of a metal matrix composite armor system containing spherical elements has been problematical insofar as achieving these objectives.

Aluminum oxide (commonly called "alumina"), silicon carbide, boron carbide, and titanium carbide are ceramic materials that are known to be suitable for armor applications. These conventional armor ceramics have been used in conventional practice of armor systems.

SUMMARY OF THE INVENTION

In view of the foregoing, an object of the present invention is to provide a metal matrix composite armor system that is durable and lightweight and that affords effective performance in resisting projectile impact.

A further object of the present invention is to provide an efficient and cost-effective method of producing such a metal matrix composite armor system.

According to a typical inventive method for making a composite armor system, a mold includes a base portion having a mold surface characterized by plural elevations. A liquid first metallic material is poured into the mold. The first metallic material has a lower melting point than has the material (typically metallic, e.g., steel) of which the mold is composed. The base portion is heated for a period of time during and after the pouring of the liquid first metallic material into the mold. Typically, the heating of the mold is ceased several minutes after the pouring of the first metallic material is commenced and completed. The poured first metallic material gradually cools after the heating of the mold is ceased, as the mold gradually cools. A first casting is removed from the mold. The first casting is composed of the first metallic material, solidified. The first casting has a casting surface characterized by plural depressions corresponding to the plural elevations of the base portion's mold surface.

The first casting is positioned in the mold upon the mold surface so that the first casting's casting surface faces upward. Plural embedment elements are placed in the depressions of the casting surface. A liquid second metallic material is poured into the mold with the first casting thus positioned upon the mold surface. The second metallic material has a lower melting point than has the first metallic material. The base portion is heated for a period of time during and after the pouring of the liquid second metallic material into the mold. The second metallic material is permitted to infiltrate, with heating persisting for a suitable period of time to promote coverage and bonding among all of the adjacent surfaces of second metallic material, the first casting, and the embedment elements. Typically, the heating of the mold is ceased several minutes after the pouring of the second metallic material is commenced and completed. The poured second metallic material gradually cools after the heating of the mold is ceased, as the mold gradually cools. An integral structure is removed from the mold. The integral structure includes the first casting, the embedment elements, and a second casting. The second casting is composed of the second metallic material, solidified.

The inventive fabrication method described in the two preceding paragraphs represents a kind of "dual casting" methodology. In accordance therewith, a first (inner) metallic component of the inventive armor product is cast using a mold. The mold, together with the first (inner) metallic component and plural embedment elements, is subsequently used again to cast a second (outer) metallic component, thereby forming the inventive armor device comprising the first (inner) metallic component, the embedment elements, and the second (outer) metallic component. According to an alternative inventive approach to making an inventive armor device, the inventive practitioner does not cast the first (inner) metallic component. Rather, the inventive practitioner provides the first (inner) metallic component by first obtaining a metallic (e.g., titanium) plate that is smooth on both faces, and then creating indentations in one of the faces, such as via embossing or another known technique for "dimensionalizing" a smooth metal surface.

The present invention's integral armor structure is typically configured, in terms of its proportions, as an armor "plate" having small through-plane thickness relative to its in-plane length and width. The inventive integral structure represents a composite armor system including metallic matrix material and plural embedment elements embedded in the metallic matrix material. The present invention's composite armor system includes a layered configuration whereby the embedment elements are situated at an interface between the first casting and the second casting. To enhance the strength (e.g., delamination resistance) of the integral structure, the second casting should be rendered completely exteriorly with respect to the first casting and the embedment elements. Each embedment element of the composite armor system is partially embedded in the first casting and partially embedded in the second casting. According to frequent inventive practice, the embedment elements are spherical. Each spherical embedment element is embedded in the first casting between approximately one-third and one-half of its diameter, and is embedded in the second casting between approximately one-half and two-thirds of its diameter.

The present invention lends itself to varied practice in several respects. Numerous metals and metal alloys can be used for the mold material, the first (inner) casting material, and the second (outer) casting material. The present invention's mold is typically made of steel, but can be made of another (typically, metallic) suitable material. The mold can be designed and constructed to be re-usable by an inventive practitioner. Good casting materials should be used for the first (inner) and second (outer) castings, especially for the second (outer) casting; generally, there are many metallic materials that are known to be suitable casting materials, and these can be considered for inventive practice. Steel is a preferred material for the mold, but other suitable mold materials can be used. A preferred first (inner) casting material is a titanium alloy. A preferred second (outer) casting material is an aluminum alloy (e.g., A356). A typical aluminum alloy is lightweight and strong, and not many other metallic materials meet both criteria as well. Some aluminum alloys and some other alloys are precipitation-hardened, and thus may represent a stronger metallic material.

In inventive testing, the present inventor used a titanium alloy as the first (inner) casting material and A356 aluminum alloy as the second (outer) casting to fabricate a small inventive prototype exhibiting excellent material properties. An aluminum alloy and a titanium alloy may afford combined attributes of light weight and strength. Another option for the first (inner) casting material that may be suitable for some inventive embodiments is Al-25% Mn alloy, an aluminum alloy composed of twenty-five percent manganese; however, a titanium alloy has less porosity and hence may be more suitable than an Al-25% Mn alloy. Steel (an alloy of iron and carbon) may be another option for the first (inner) casting material, but its drawback may be its heavy weight.

Particularly important in inventive practice are the requirements for selecting materials that are suitable in terms of the relative melting temperatures of the materials. The mold material must have a higher melting temperature than the first (inner) casting material. The first (inner) casting material must have a higher melting temperature than the second (outer) casting material. Similarly, the embedded element material (e.g., ceramic) must have a higher melting temperature than the second (outer) casting material. The first (inner) casting material should not have any low temperature eutectic point. Materials should be selected to suit the particular armor applications for which the inventive embodiments are intended. Generally speaking, the metallic casting materials should be strong and lightweight. Materials should be selected in terms of compatibilities, not only with respect to melting temperatures, but also to promote wetting of solid casting materials by liquid casting materials. No pyrophoric materials (e.g., magnesium) should be used in inventive fabrication; a pyrophoric material is commonly regarded, in a general sense, as a material that automatically or spontaneously ignites or bursts into flames on contact with or exposure to air or another oxygen-containing substance.

The term "wetting" is conventionally understood to refer to contact between a liquid material and a solid material. Wetting is associated with intermolecular interactions between the liquid and solid materials that are brought together. Generally speaking, the amount of wetting relates to the contact angle between the liquid-gaseous interface and the solid-liquid interface. The smaller is the contact angle, the greater is the wetting. Furthermore, the greater is the wetting, the greater is the tendency of the liquid to spread over a larger area of the solid surface, and hence the better is the adherence (bonding) between the liquid material and the solid material. A high degree of wetting—and hence, of adherence/bonding—is desirable in the first casting process and especially in the second casting process of the inventive fabrication methodology. In the present invention's first casting process, extensive wetting is preferred of the mold by the liquid first casting material. In the present invention's second casting process, extensive wetting is preferred of the solid first casting material and the solid spheres, by the liquid second (outer) casting material.

In both the first and second casting processes, the heat should continue to be applied for several minutes after pouring, so that the metallic casting material remains molten for several minutes after pouring, thereby ensuring bonding of all surfaces; at an appropriate point, the heat can be turned off so that the mold gradually cools down. In other words, the mold should be heated for a suitable period for the first casting process, and re-heated for a suitable period for the second casting process. The temperature of the mold should be at or near the melting point of the metallic casting material used to pour into the mold.

In order to optimize bonding, inventive practice frequently prefers that the second (outer) casting totally surround the first (inner) casting. If the first (inner) casting material and the second (outer) casting material merely describe discrete adjacent layers, with no surrounding of the first (inner) casting material by the second (outer) casting material, the risk of delamination will be greater. During the second casting process, some of the second (outer) casting material, which is typically very fluid, flows around the first (inner) casting and between the first (inner) casting and the mold; that is, the second (outer) casting material "crawls" below the first (inner) casting and above the topside dimpled surface of the mold. Enough second (outer) casting material should be poured to completely cover/coat the spheres and leave some degree of thickness above the spheres.

The desired thickness of the second (outer) casting material above the embedment elements may depend on the contemplated armor application of the inventive armor product. Generally in the case of spherical embedment elements, in furtherance of bonding of the liquid second (outer) casting material to surfaces of the spherical elements and the solid first (inner) casting, inventive practice calls for a thickness, above the spherical elements, of the second (outer) casting material that is in the approximate range between one-quarter and one-third of the diameter of the spherical elements. The inventive practitioner can weigh the armor-related benefit of additional above-spheres thickness of the second (outer) casting material, versus the detriment thereof in terms of the additional weight associated with the additional volume of the second (outer) casting material.

It is emphasized that an inventive armor product following the second casting process can be subjected to further inventive processing, such as being machined and/or shaped and/or bent and/or combined with another structure, to suit one or more contemplated armor applications. Of particular note, two or more inventive armor structures can be combined to form a larger inventive armor device comprising the smaller inventive armor structures. For instance, plural inventive armor structures, each characterized by planar layers including a planar layer of embedment elements, can be stacked to form a multi-layered armor device having plural planar layers of embedment elements. Additionally or alternatively, plural inventive armor structures can be arranged side-by-side to form an armor device having a larger planar area, thus presenting a larger strike face for defending against projectiles.

The embedment elements can be made of any hard and relatively tough material, such as a metallic material, a polymeric material, a glass material, or a ceramic material. Examples of suitable ceramic materials include silicon carbide (SiC), boron carbide (BC), titanium carbide (TiC), aluminum oxide ($Al_2O_3$), boron nitride (BN), etc. Ceramic balls suitable for inventive practice are commercially available, primarily manufactured for bearing applications. For instance, for his inventive testing the present inventor obtained hard silicon nitride (SiN) spheres from Saint Gobain Ceramics CERBEC® USA, East Granby, Conn. 06026, www.cerbec.com.

According to frequent inventive practice, prior to being placed in the indentations, the embedment elements are coated with another material to provide a surface that promotes wetting by the second (outer) metallic casting material. For instance, a silver surface can be provided for the embedment elements to promote bonding of the embedment elements to the second (outer) casting material, e.g., a suitable aluminum casting alloy. For instance, the present inventor obtained (from the aforementioned manufacturer Saint Gobain Ceramics) ceramic (SiN) spheres, each having a mirror-smooth surface. The present inventor placed the SiN spheres, along with boron carbide powder ($B_4C$, −325 mesh) in a ball mill, and milled the SiN spheres and BaC powder together for several hours. The $B_4C$ powder was found, with some searching by the present inventor, to be the only material available that was harder than the SiN of the spheres. As a result of the milling, the surfaces of the ceramic spheres were abraded. The ceramic spheres were then coated with silver in accordance with the method disclosed by the present inventor at U.S. Pat. No. 5,091,362, issued date 25 Feb. 1992, invention title "Method for Producing Silver Coated Superconducting Ceramic Powder," incorporated herein by reference. The method of Ferrando U.S. Pat. No. 5,091,362 involves decomposition of a silver-containing compound to form a thin uniform coating of silver metal on the surface of a particle.

According to many preferred inventive embodiments, the embedment elements are spherical. For instance, spherical embedment elements can all be congruent (geometric spheres with equal diameters), and can be arranged in a regular pattern to be embedded thusly. Nevertheless, multifarious shapes, sizes, and distributions of the embedment elements can be inventively selected and effected, with the ultimate armor objectives (such as deflections of particular projectiles) kept in mind by the inventive practitioner. For instance, embedment elements of varying shapes and/or sizes can be used within a single array of embedment elements essentially describing a single geometric plane. If embedment elements all of the same shape (e.g., spherical) are used, they can be of the same size or different sizes. Additionally or alternatively, the coplanar embedment elements can be arranged in any of a variety of one-dimensional patterns. Moreover, instead of spherical, the embedment elements can be prolate spheroidal (e.g., egg-shaped elements having parallel longitudinal axes) or cylindrical (e.g., short rod-shaped elements having coplanar longitudinal axes).

It is generally preferred inventive practice that the embedment elements be spaced apart (i.e., not touch each other) when they are placed in the indentations of the first (inner) casting, so that they will be spaced apart accordingly when they are completely embedded in dichotomized metallic materials via the second inventive casting process. At least slight separations between the embedded elements are preferred, because the inventive armor product will thus be more effective in defending against projectiles. For instance, if spherical embedded elements are at least slightly separated from each other, they will transfer energy directly from one ball to another upon impact by a projectile. Therefore, the design of the original mold, particularly with respect to its "pimpled" surface, is significant. The protuberances of the original mold's bottom inner surface should be arranged in such a way that the embedded elements, when placed in the first (inner) casting's indentations corresponding to the mold's protuberances, are completely separated from each other.

Other objects, advantages and features of the present invention will become apparent from the following detailed description of the present invention when considered in conjunction with the accompanying drawings.

BRIEF DESCRIPTION OF THE DRAWINGS

The present invention will now be described, by way of example, with reference to the accompanying drawings, wherein like numbers indicate same or similar parts or components, and wherein:

As shown in FIG. 5, the first metallic casting's dimpled side faces downward.

FIG. 6 illustrates vertical peripheral grooves provided in the edgewise periphery of the first metallic casting, and also shows the first metallic casting's interior "dimples" in transparency.

As illustrated in FIG. 10, the first metallic casting is situated, dimpled side horizontal and up, atop the pimpled horizontal upper surface of the base section of the mold. The cross-sectional view of FIG. 10 is taken essentially through a geometric plane indicated by section line 10-10 in FIG. 11.

FIG. 14 is the view of FIG. 11, additionally showing placement of spherical elements in the dimples of the first metallic casting.

FIG. 20 and FIG. 21 illustrate two opposite orientations of an inventive composite armor product embodiment with respect to an impinging projectile.

As illustrated in FIG. 23 through FIG. 25, parallel horizontal channels and parallel vertical channels (which are narrower than the horizontal channels) intersect each other at "drop-in" locations suitable for placement of spherical elements (which are narrower than the horizontal channels but wider than the vertical channels).

FIG. 24 and FIG. 25 are the same cross-sectional elevation view, sectioned essentially through one of the horizontal channels shown in FIG. 23. As illustrated in FIG. 24 and FIG. 25, each spherical element can be placed by pushing it (and/or causing it to roll) along a horizontal channel so that the spherical element arrives and remains at a drop-in location. Each drop-in location is defined by the intersection of a horizontal channel and a vertical channel.

DETAILED DESCRIPTION OF THE INVENTION

Figure 1:
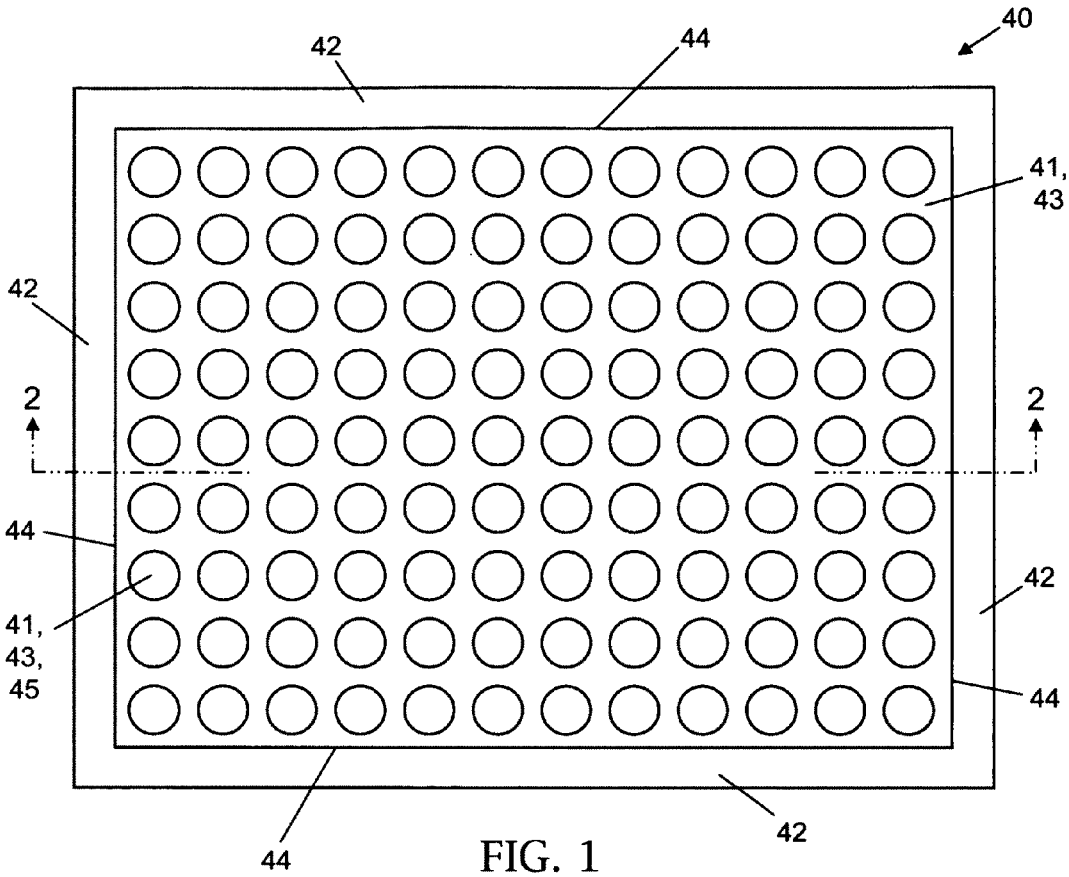
FIG. 1 is a top plan view of an embodiment of a "pimpled" mold in accordance with the present invention. The mold includes a base section having a pimpled horizontal upper surface.
Figure 2:
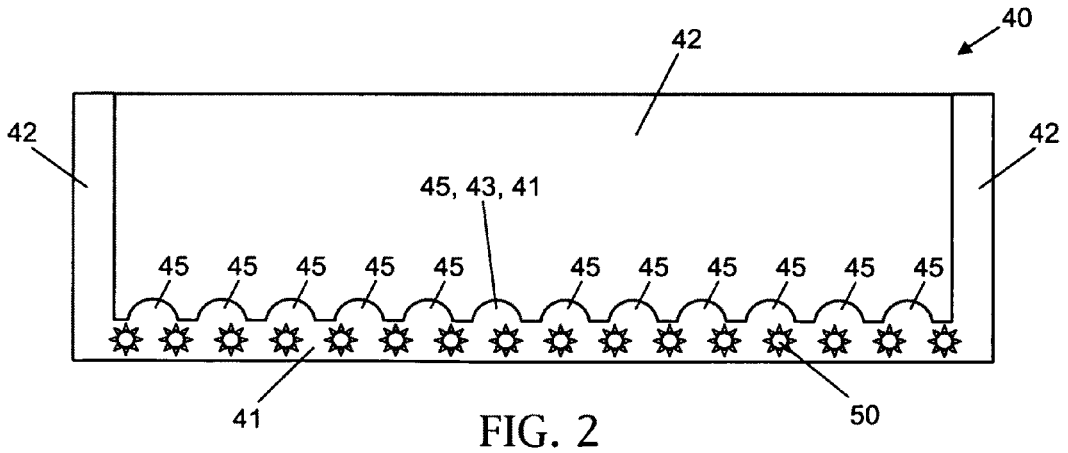
FIG. 2 is a cross-sectional elevation view of the mold shown in FIG. 1, taken essentially through a geometric plane indicated by section line 2-2 in FIG. 1. Also shown in FIG. 2 are symbolic representations of heating elements associated with the base section of the mold.

Referring now to FIG. 1 and FIG. 2, steel tray-like mold 40 includes a horizontal base plate portion 41 and four vertical wall portions 42. The inside surfaces of mold 40 include the "pimpled" upper surface 43 of horizontal base plate portion 41 and the respective smooth (even) side surfaces 44 of vertical wall portions 42. The pimpled upper surface 43 of base plate portion 41 is characterized by a regular pattern of congruent elevations 45, each of which describes the geometric shape of a sphere that is horizontally truncated below its apex, at or above its horizontal planar bisector. Associated with mold 40 (for instance, coupled with base plate portion 41) are heating devices 50.

With reference to FIG. 3 through FIG. 9, the interior surfaces (including upper surface 43 and side surfaces 44) of mold 40 are coated, as appropriate, with a mold release agent (e.g., zirconium oxide or zirconia). Heating devices 50 serve to extremely raise the temperature of mold 40 and thereby facilitate casting processes in accordance with the present invention. Heating devices 50 are activated to prepare for a first inventive metallic casting process. The melting point of mold 40 must be higher than the melting point of the first metallic casting material 100, which is designated herein "100L" when in liquid form, and "100S" when in solid form.

Figure 3:
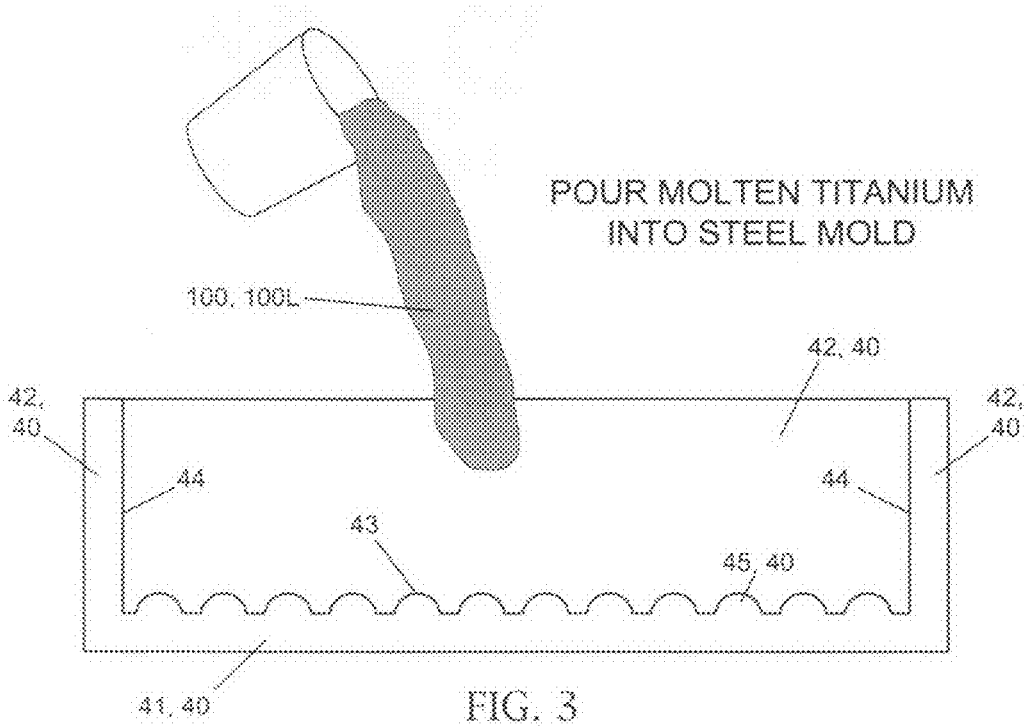
FIG. 3 is a diagram, including the view of FIG. 2, illustrating the pouring of a "first" liquid metallic material into the mold in accordance with an embodiment of an armor fabrication method of the present invention.
Figure 4:
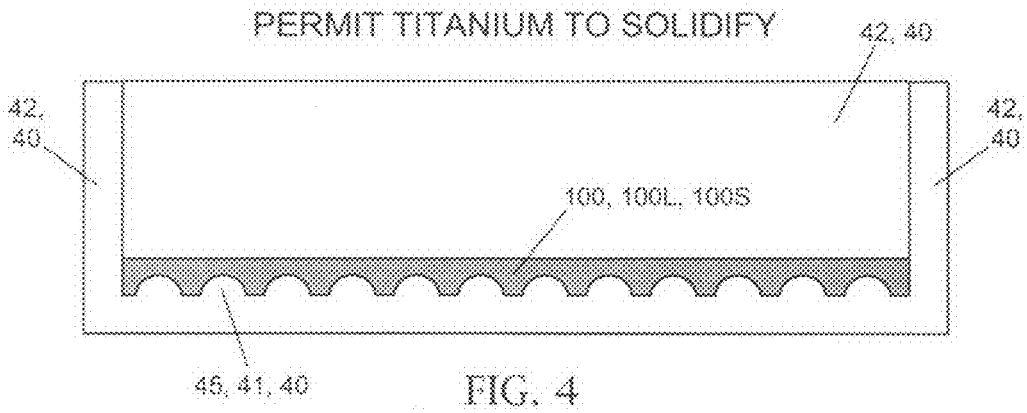
FIG. 4 is a view, similar to the views of FIG. 2 and FIG. 3, of the mold and the dimpled "first" metallic casting (i.e., the first metallic material, solidified).

As illustrated in FIG. 3 and FIG. 4, hot liquid titanium or titanium alloy material 100L is poured into mold 40. For convenience, the titanium or titanium alloy is referred to herein simply as "titanium." Enough molten metallic material 100L should be poured not only to completely cover the pimpled upper surface 43, but also to provide an additional thickness of the molten metallic material 100L above the elevations 45. The amount poured of the molten metallic material 100L, which determines the additional thickness of the solidified metallic material 100L, may depend on the contemplated application(s) of the completed inventive armor 500.

Mold 40 should be heated via heating devices 40 to a temperature at or near the melting point of the first metallic casting material 100 for a suitable period of time (e.g., for several minutes) to ensure complete settling of the first liquid metallic casting material 100L within mold 40. Several minutes after the first metallic material 100L is poured, the heating devices 50 are inactivated. The molten titanium 100L is permitted to cool and solidify for several hours to form a first inventive metallic casting 100S, which is a solid titanium piece.

First metallic casting 100S is removed from mold 40. First metallic casting 100S is a metallic plate having two opposite faces, namely, a smooth (even) surface 101 and a "dimpled" surface 102. Dimpled surface 102 represents a kind of "egg crate" configuration. Dimpled surface 102 is characterized by a regular pattern of congruent depressions 105, each of which describes the geometric shape of a sphere that is horizontally truncated above its nadir, at or below its horizontal planar bisector. The congruent depressions 105 of dimpled surface 102 correspond to the congruent elevations 45 of pimpled surface 43.

Figure 6:
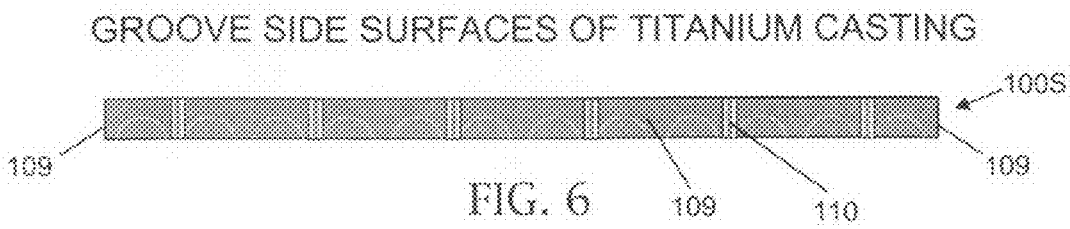
FIG. 6 is an elevation view of the first metallic casting, similar to the cross-sectional view of FIG. 5.
Figure 7:
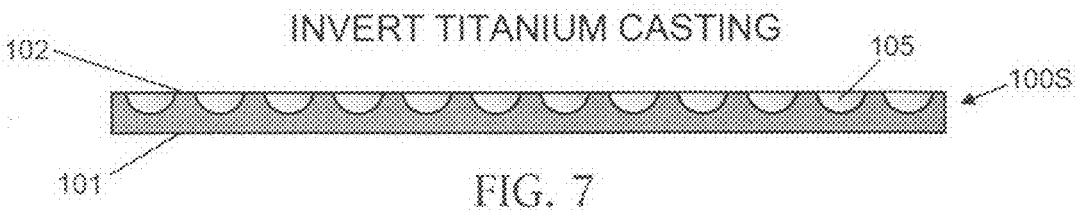
FIG. 7 is the view of FIG. 5, flipped (upturned) so that the first metallic casting's "dimpled" side faces upward. The cross-sectional view of FIG. 7 is taken essentially through a geometric plane indicated by section line 7-7 in FIG. 9.
Figure 8:
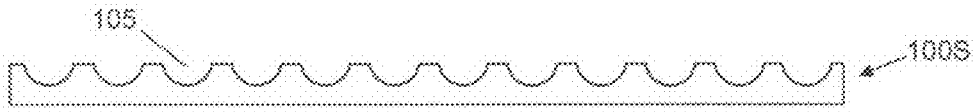
FIG. 8 is a geometric planar profile representative of the cross-sectional view of FIG. 7.
Figure 9:
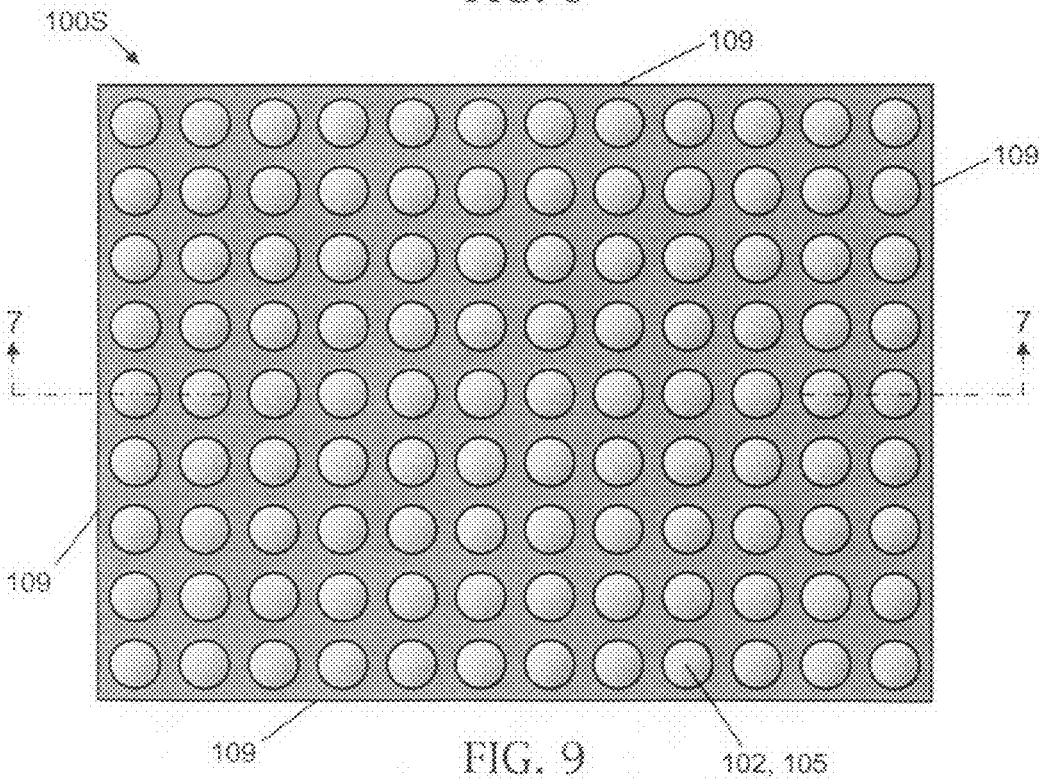
FIG. 9 is a top plan view of the first metallic casting shown in FIG. 7.
Figure 10:
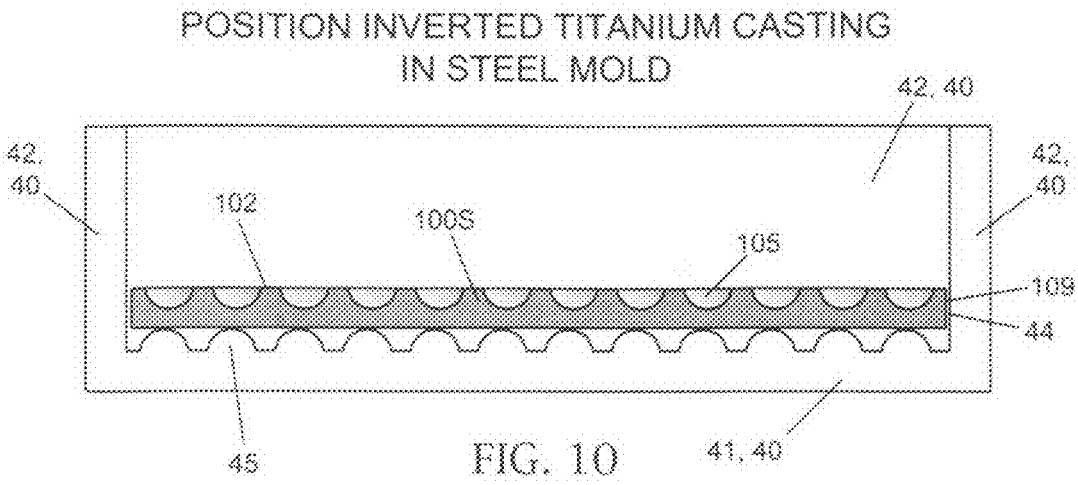
FIG. 10 is the view of FIG. 2 (of the mold) together with the view of FIG. 7 (of the first metallic casting).
Figure 11:
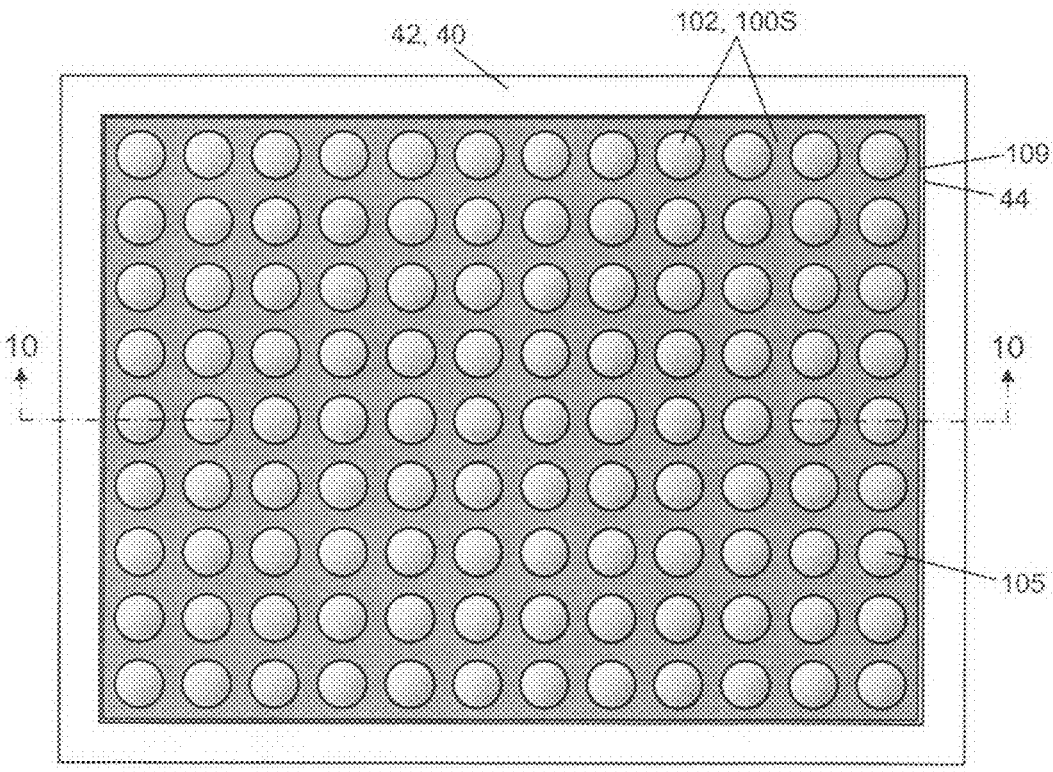
FIG. 11 is a top plan view of the mold-plus-casting assembly shown in FIG. 10.
Figure 12:
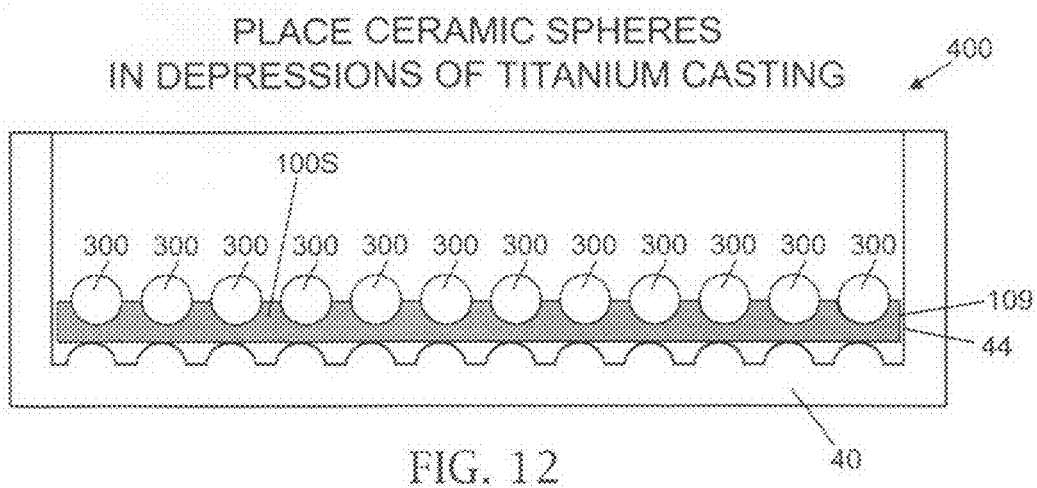
FIG. 12 is the view of FIG. 10, additionally showing placement of spherical elements in the dimples of the first metallic casting. The cross-sectional view of FIG. 12 is taken essentially through a geometric plane indicated by section line 12-12 in FIG. 14.

Before first metallic casting 100S is situated in an inverted horizontal position within mold 40, an optional and sometimes preferred embellishment in inventive practice is to machine vertical grooves 110 (such as shown in FIG. 6) around the periphery 109 of first metallic casting 100S. Grooves 110 will serve as flow channels for facilitating the downward gravitational flow of the second liquid metallic casting material 200L, during a second inventive metallic casting process.

Figure 5:
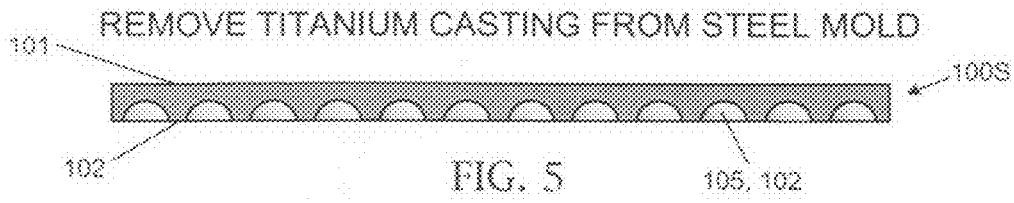
FIG. 5 is a cross-sectional elevation view, sectioned essentially through the dimples, of the first metallic casting shown in FIG. 4.

Now referring to FIG. 10 through FIG. 17, the interior surfaces (including upper surface 43 and side surfaces 44) of mold 40 are coated again, as appropriate, with a suitable mold release agent (e.g., zirconium oxide or zirconia). The first metallic casting 100S is positioned in mold 40 in an inverted orientation—i.e., with the depressions 105 facing upward, as shown in FIG. 7 through FIG. 11. In other words, first metallic casting 100S is inverted vis-à-vis its orientation when cast in mold 40, as shown in FIG. 4 and FIG. 5. The periphery 109 of the first metallic casting 100S abuts the inwardly facing side surfaces 44 of the mold 40's vertical wall portions 44.

Figure 13:
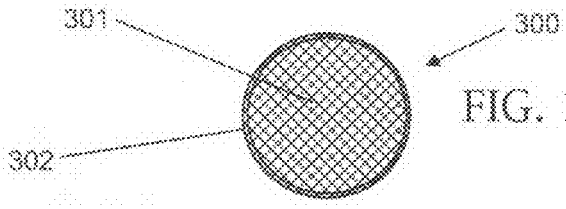
FIG. 13 is a diametric cross-sectional view of one of the spherical elements shown in FIG. 12, in particular illustrating a ceramic core and a metallic (e.g., silver) coating.
Figure 14:
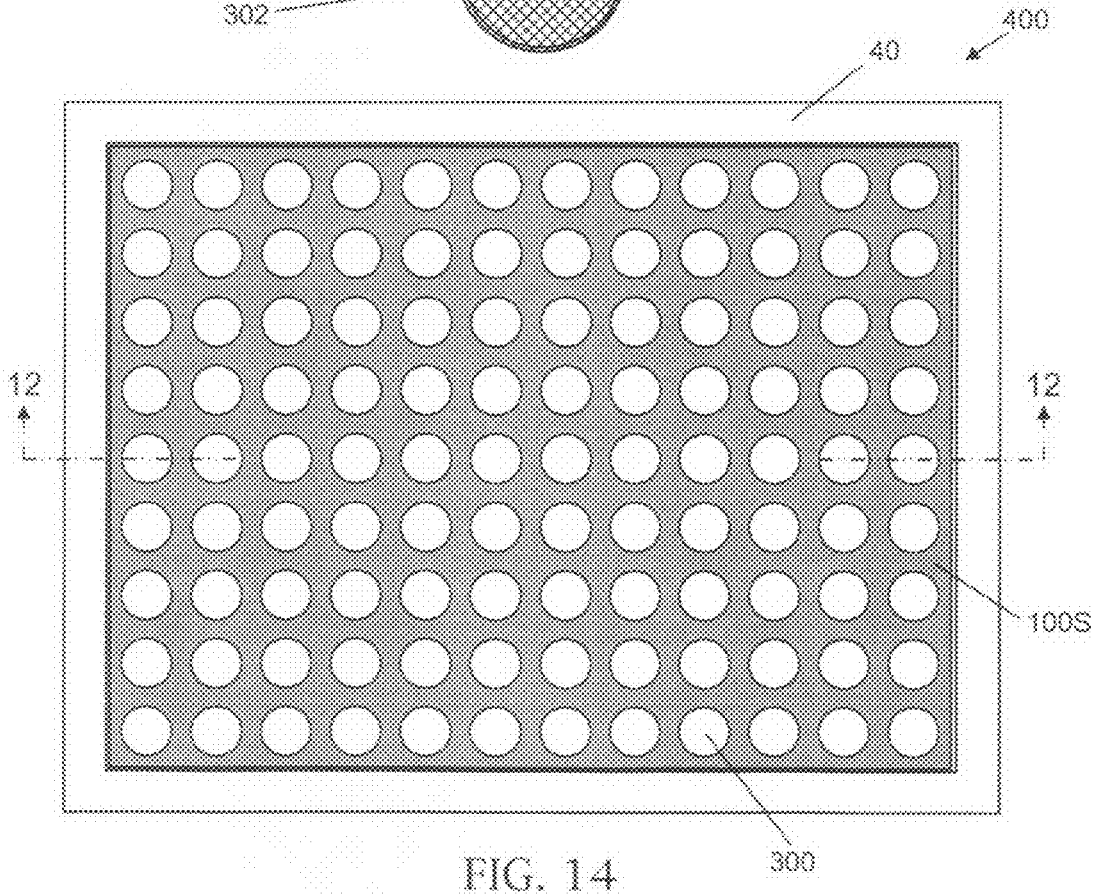
FIG. 14 is a top plan view of the mold-plus-casting-plus-spheres assembly shown in FIG. 12. In other words.

Spherical elements 300 are placed in the upward facing depressions 105 of the first metallic casting 100S, one spherical element 300 per depression 105. Spherical elements 300 should be characterized by an at least slightly smaller diameter than are the depressions 105, in order that the spherical elements can be placed in the depressions 105 and remain in place. Preferably for many inventive embodiments, spherical elements 300 are slightly smaller in diameter than depressions 105 in order that the spherical elements fit snugly when placed in the depressions 105. Frequently preferred inventive practice utilizes spherical elements 300 each having a ceramic core 301 and a silver coating 302 such as depicted in FIG. 13, the silver coating having been provided in accordance with the afore-noted methodology taught by Ferrando U.S. Pat. No. 5,091,362.

As shown in FIG. 2 through FIG. 5, elevations 45 geometrically constitute a truncated sphere having slightly less than one-half of the diameter of an entire sphere. Since the depressions 105 of first metallic casting 100S are cast from the elevations of mold 40, depressions 105 likewise geometrically constitute a truncated sphere having slightly less than one-half of the diameter of an entire sphere, as shown in FIG. 5, FIG. 7, FIG. 8 and FIG. 10. Therefore, as shown in FIG. 12 and FIG. 15 through FIG. 17—and there is some approximation here because each spherical element 300 is shown to be slightly smaller than its corresponding depression 105—each spherical element 300 is recessed within a depression 105 to a corresponding depth of slightly less than one half of the diameter of the spherical element 300. According to typical inventive practice, each spherical element 300 is recessed within a depression 105 to a depth in the approximate range between one-third and one-half of the diameter of the spherical element 300. As the present invention is frequently practiced, congruent spherical elements 300 are all recessed within their corresponding depressions 105 to the same or approximately the same depth. In accordance with the spacing of the mold 40's elevations 45 and hence of the first metallic casting 100S's depressions 105, the spherical elements 300 when placed in the depressions 105 are spaced apart from each other.

Heating devices 50 are activated again to prepare for the second inventive metallic casting process. The melting point of mold 40 must be higher than the melting point of both the first metallic casting material 100 and the second metallic casting material 200. Further, the melting point of the first metallic casting material 100 must be higher than the melting point of the second metallic casting material 200 (which is designated herein "200L" when in liquid form, and "200S" when in solid form).

Figure 15:
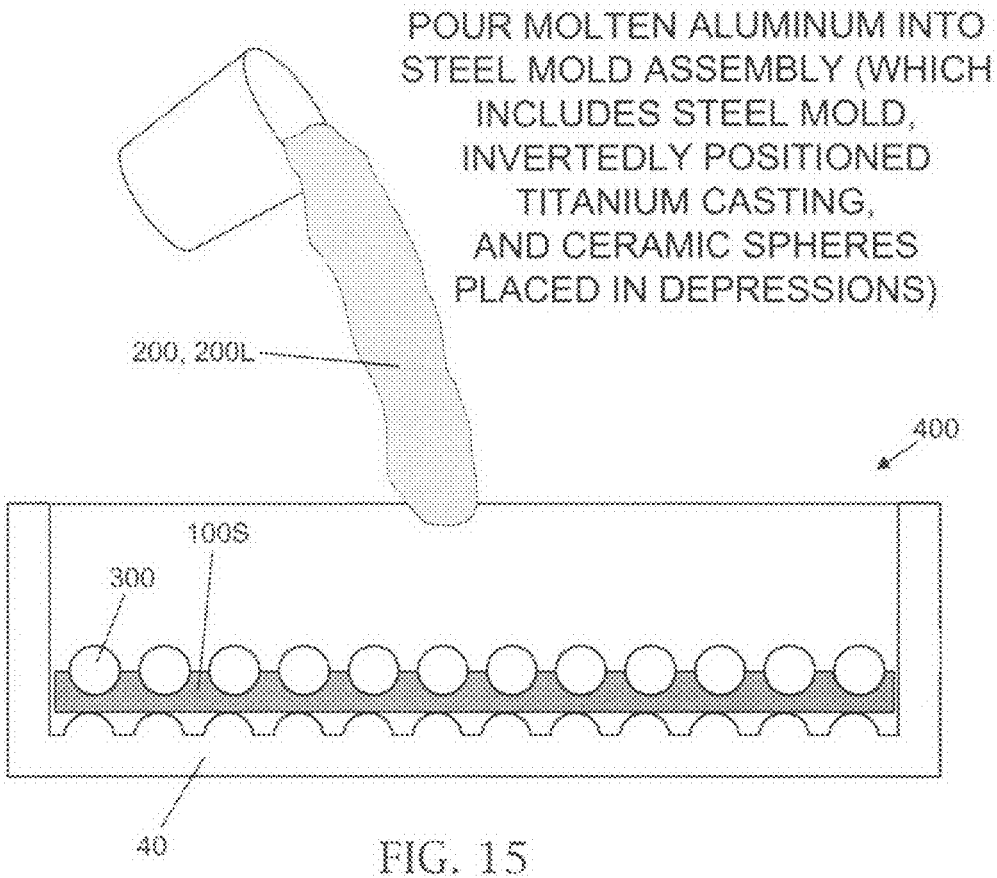
FIG. 15 is a diagram, including the view of FIG. 12, illustrating the pouring of a "second" liquid metallic material into the mold-plus-casting-plus-spheres assembly in accordance with an embodiment of an armor fabrication method of the present invention.
Figure 16:
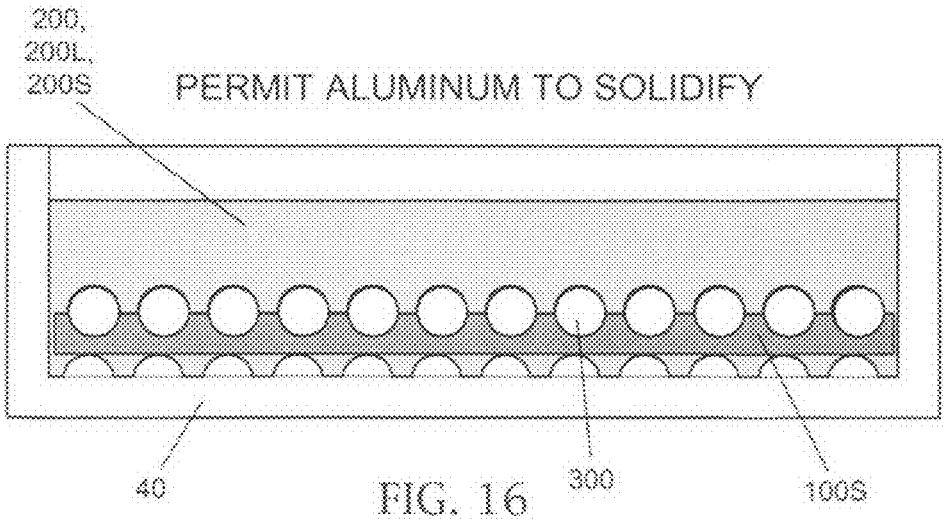
FIG. 16 is a view, similar to the views of FIG. 12 and FIG. 15, of the mold-plus-casting-plus-spheres assembly in combination with the "second" metallic casting (i.e., the second metallic material, solidified).

As illustrated in FIG. 15 and FIG. 16, hot liquid aluminum or aluminum alloy material 200L is poured into the mold assembly 400, which includes mold 40, first metallic casting 100S, and spherical elements 300. For convenience, the aluminum or aluminum alloy is referred to herein simply as "aluminum." Enough molten metallic material 200L should be poured not only to completely cover the dimpled surface 102 and spherical elements 300, but also to seep around and below the first metallic casting 100S as well as to provide an additional thickness of the molten metallic material 200L above the spherical elements 300. The amount poured of the molten metallic material 200L, which determines the additional thickness of the solidified metallic material 200L, may depend on the contemplated application(s) of the completed inventive armor 400.

Mold 40 should be heated via heating devices 50 to a temperature at or near the melting point of the second metallic casting material 200 for a suitable period of time (e.g., for several minutes) to ensure complete flow of the second liquid metallic casting material 200L within mold assembly 400 and circumscriptive of first metallic casting 100S and spherical elements 300; in particular, complete bonding should be achieved of the second liquid metallic casting material 200L with respect to the adjoining outside surfaces of the first metallic casting 100S and the spherical elements 300.

Figure 17:
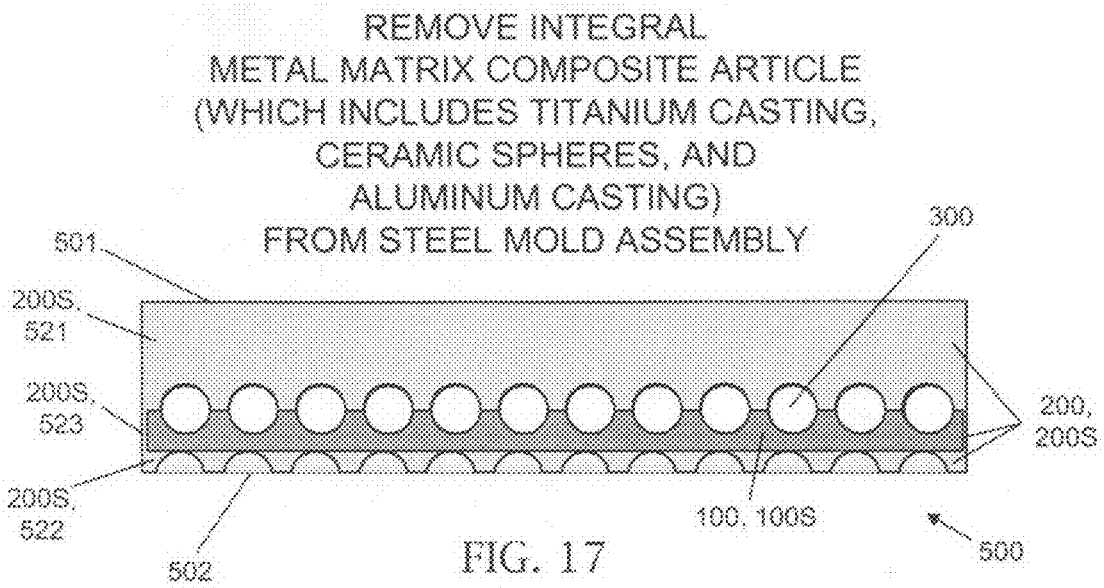
FIG. 17 is a view, similar to the view of FIG. 16, of an embodiment of the present invention's composite armor system. The cross-sectional view of FIG. 17 is taken essentially through a geometric plane indicated by section line 17-17 in FIG. 18. The inventive composite armor system shown in FIG. 17 is a product of inventive fabrication method steps including those illustrated in FIG. 1 through FIG. 17.
Figure 18:
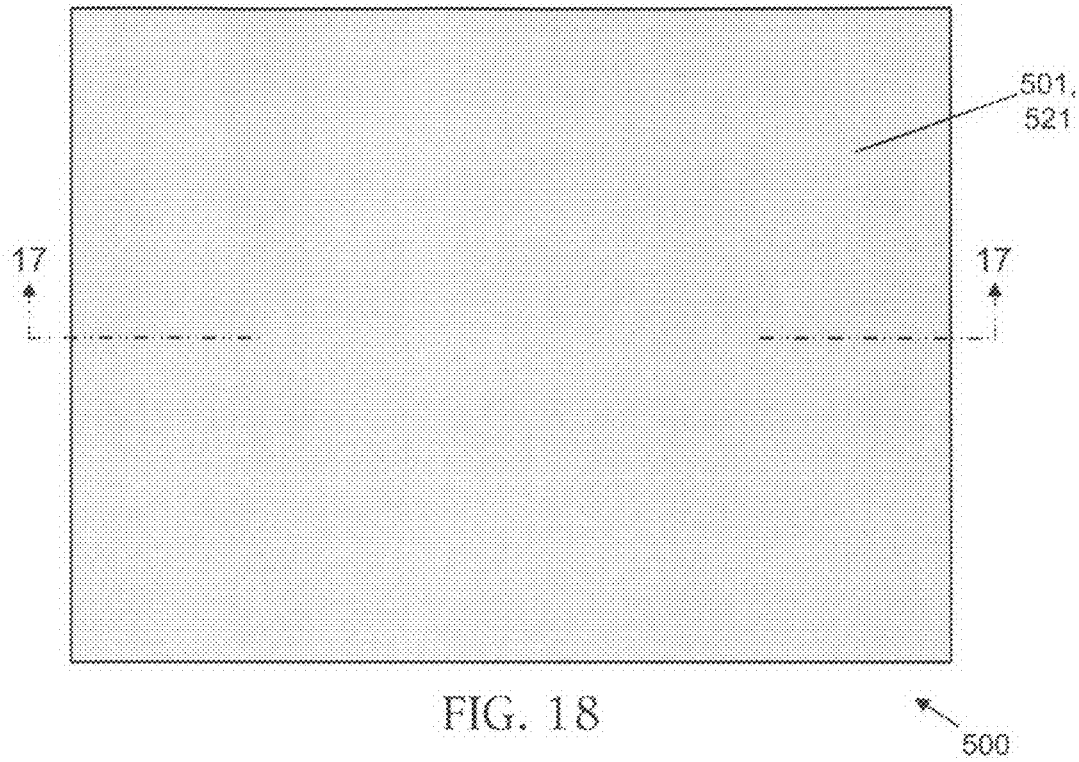
FIG. 18 is a top plan view of the inventive composite armor product shown in FIG. 17.
Figure 19:
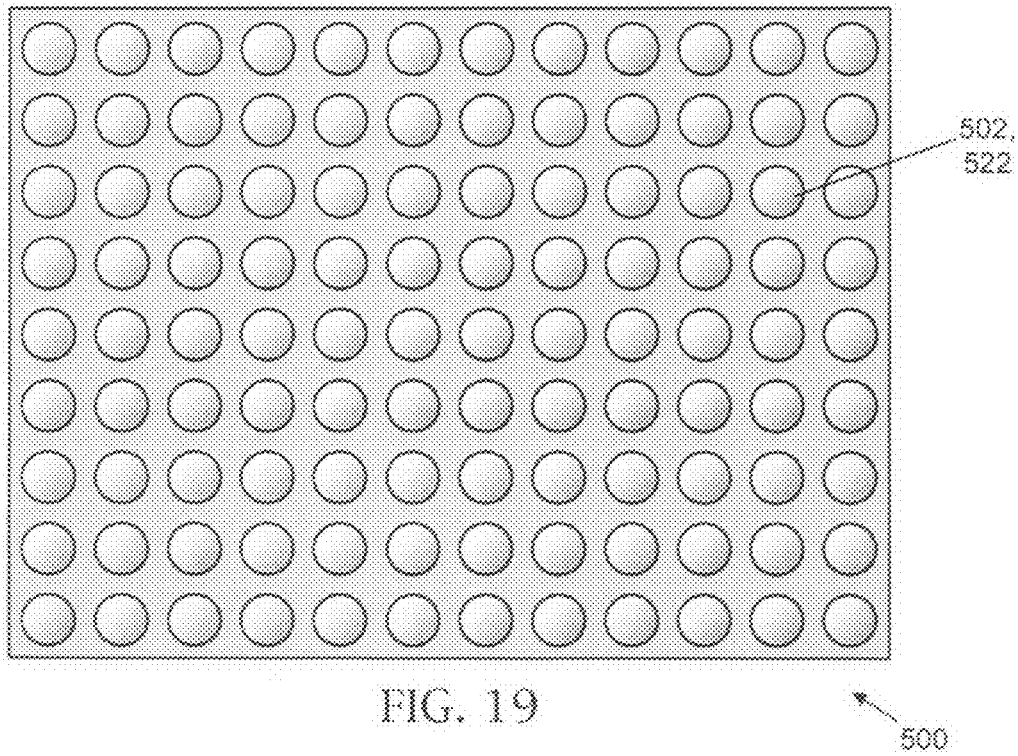
FIG. 19 is a bottom plan view of the inventive composite armor product shown in FIG. 17.

Several minutes after the molten second metallic material 200L is poured, the heating devices 50 are inactivated. The molten aluminum 200L is permitted to cool and solidify for several hours to form a second metallic casting 200S, which is integrated with the first metallic casting 100S and the spherical elements 300. As depicted in FIG. 17 through FIG. 19, the first metallic casting 100S, the spherical elements 300, and the second metallic casting 200S together constitute a solid composite piece—more specifically, an inventive ceramic-embedded dual-metal matrix composite system 500, a device suitable for armor applications.

Figure 20:
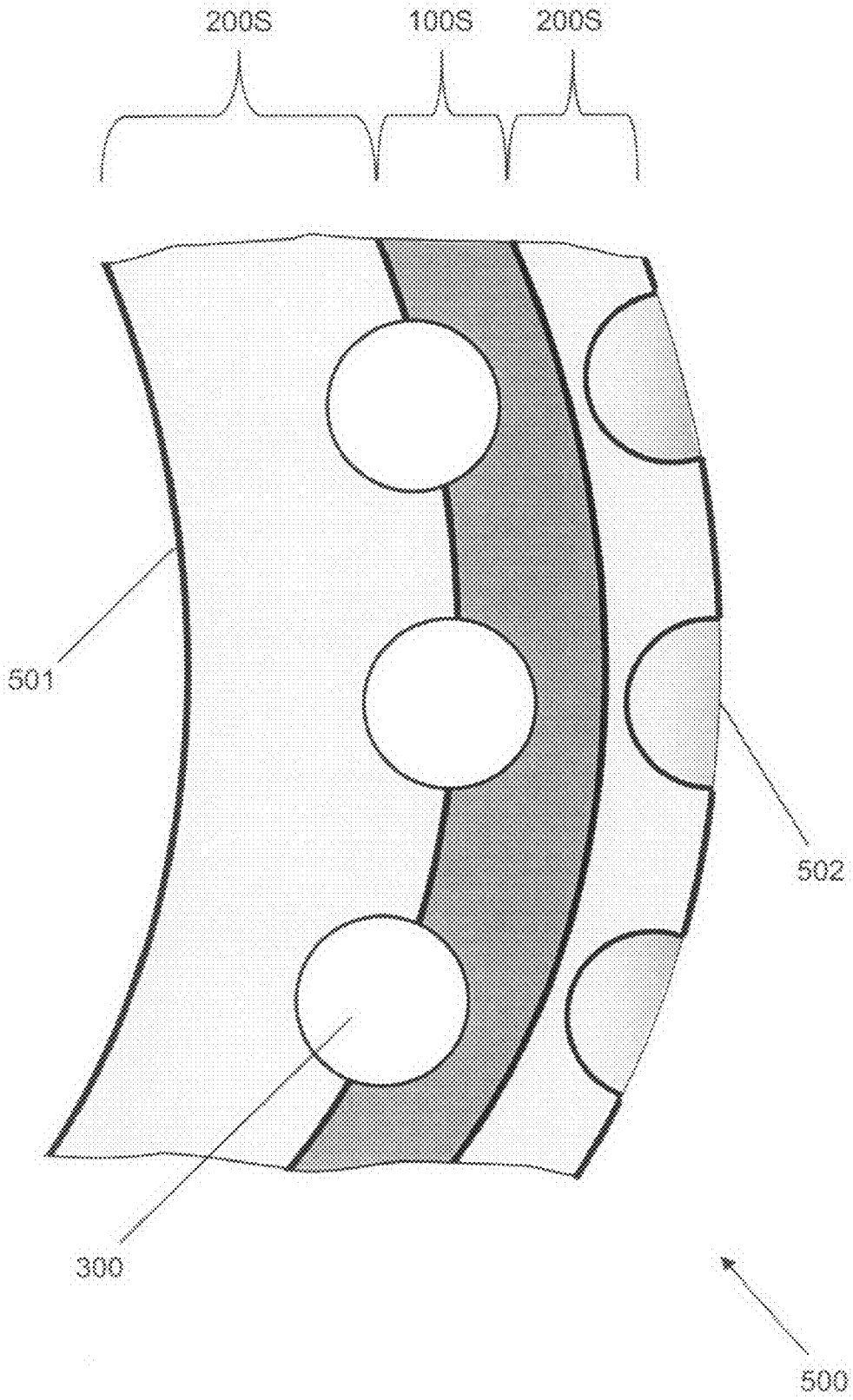
FIG. 20 is a partial and enlarged view, similar to the view of FIG. 17, of an inventive composite armor product embodiment that is bent in order to conform to a particular curved surface, such as of a vehicle characterized by surface contours.
Figure 23:
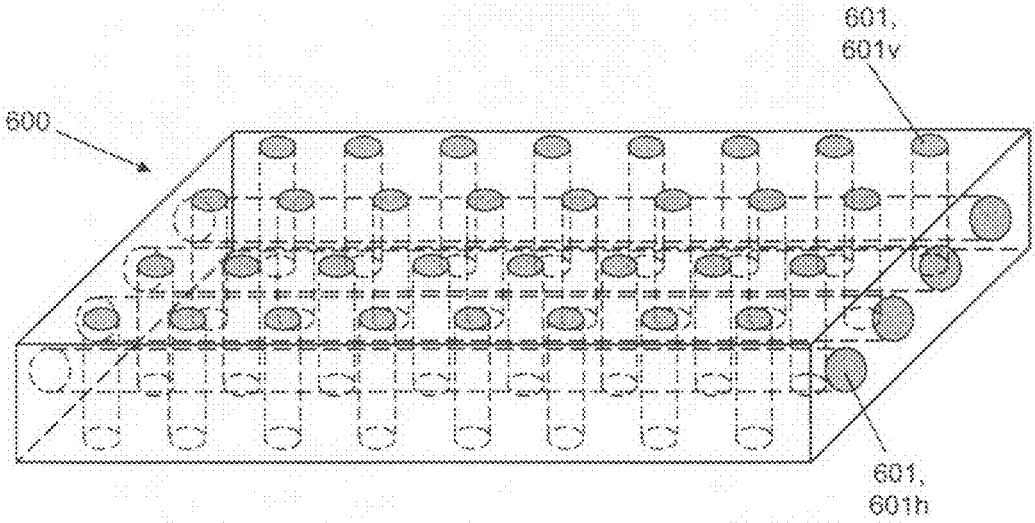
FIG. 23 is a perspective view of a cross-bored metallic block in accordance with another mode of inventive practice.
Figure 24:
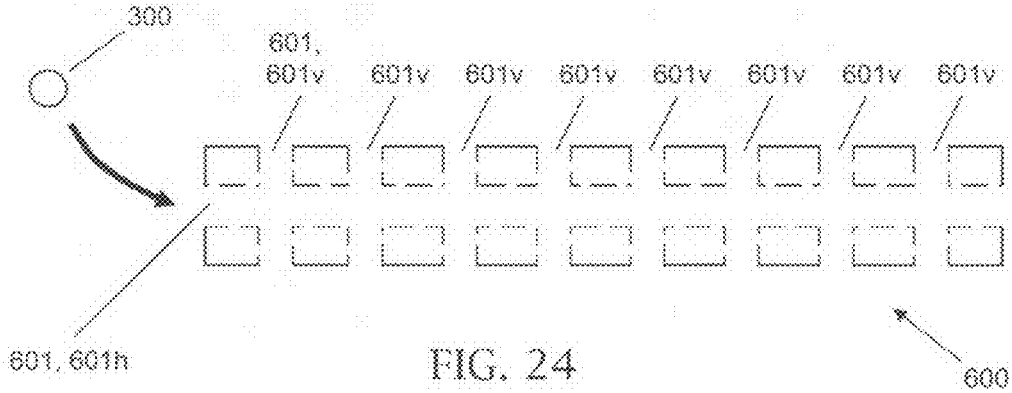
Figure 25:
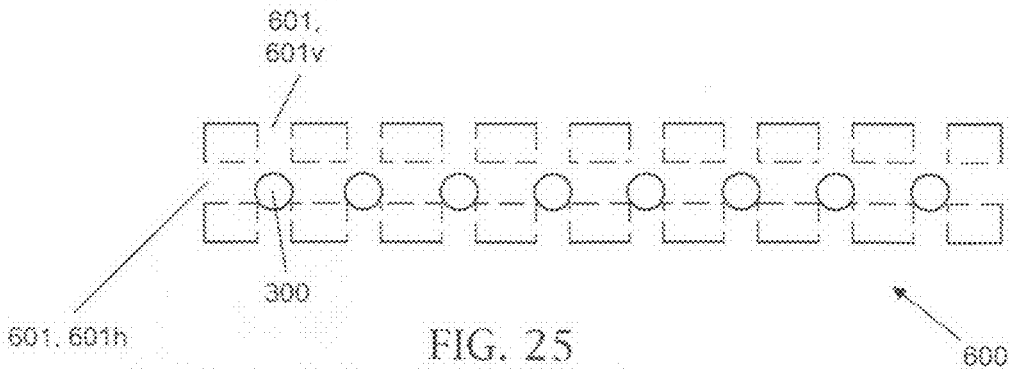

A "straight" (planar) inventive embodiment is depicted in FIG. 17 through FIG. 19. A "curved" (contoured) inventive embodiment is depicted in FIG. 20. Both straight/planar and curved/contoured inventive embodiments can be made in accordance with inventive fabrication methodology such as described herein with reference to FIG. 1 through FIG. 17. A curved/contoured inventive embodiment would typically require an additional production phase involving bending or shaping of a straight/planar product of the inventive fabrication methodology.

The inventive composite armor system 500, shown in FIG. 17 to be removed from the mold 40, is an integrated product that includes three components, viz., the first metallic casting 100S, the spherical elements 300, and the second metallic casting 200S. Since the second metallic casting 200 component circumscribes (or nearly circumscribes) the first metallic casting 100 component and the spherical elements 300 component, the first metallic casting 100 component and the second metallic casting 200 component may be described as the "inner casting" and the "outer casting," respectively.

Note that the second metallic casting 200S component of the inventive composite armor system 500 includes an upper second metallic casting layer 521, a lower second metallic casting layer 522, and four peripheral second metallic casting layers 523. The lower second metallic casting layer 521 covers the first metallic casting 100S's smooth (even) surface 101. The upper second metallic casting layer 522 covers: the upper portions of the spherical elements 300; the smooth/even portions of the first metallic casting 100S's dimpled surface 102 that are between the spherical elements 300; the interface between the depressions 105 and the lower portions of the spherical elements 300. The four peripheral second metallic casting layers 523 cover the first metallic casting 100S's periphery 109.

Typically during an inventive fabrication process, some liquid second metallic casting material 200L seeps around the first metallic casting 100S's periphery 109 and settles below the first metallic casting 100S's smooth (even) surface 101, eventually covering the entire surface 101. The peripheral second metallic casting layers 523 and the lower second metallic casting layer 521 layer correspond, respectively, to the lateral downward gravitational flow of the highly fluid second metallic material 200L around the first metallic casting 100S, and to the continued flow thereof beneath the first metallic casting 100S. Also typically during an inventive fabrication process, some liquid second metallic casting material 200L seeps around and settles below the spherical elements 300, with the result that some of the upper second metallic casting layer 522 is situated between the depressions 105 and the lower portions of the spherical elements 300.

Figure 21:
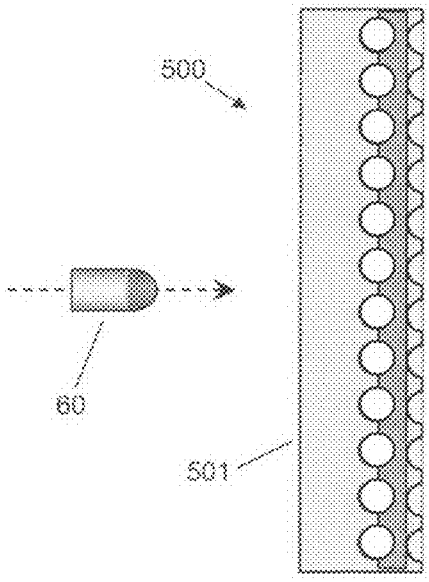
FIG. 21 and FIG. 22 are diagrams that include the view of FIG. 17, rotated ninety degrees.
Figure 22:
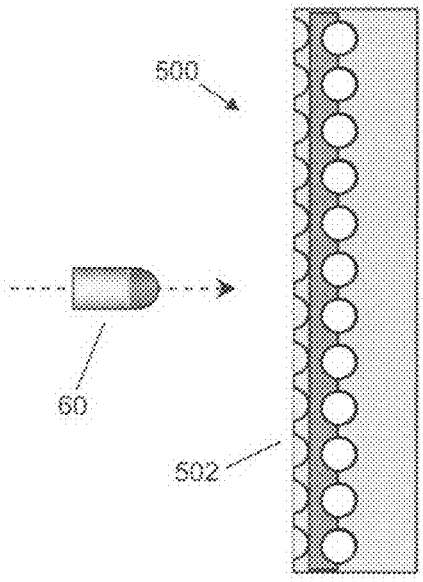

With reference to FIG. 21 and FIG. 22, in armor application an inventive composite armor system 500 lends itself to either of two basic dispositions relative to a projectile 60. As portrayed in FIG. 21, the inventive composite armor system 500 is oriented with its smooth surface 501 as the strike face. In contrast, as portrayed in FIG. 22, the inventive composite armor system 500 is oriented with its dimpled surface 502 as the strike face.

Reference now being made to FIG. 23 through FIG. 28, a different mode of inventive practice involves the boring (e.g., drilling) of horizontal and vertical holes (e.g., cylindrical channels) 601 in a solid metallic block 600. The horizontal set of holes 600*h* and the vertical set of holes 601*v* are each bored at least partially through solid metallic block 600. The horizontal holes 600*h* describe at least one horizontal geometric plane and have the same horizontal hole diameter. The vertical holes 600*v* describe at least one vertical geometric plane and having the same vertical hole diameter, which is smaller than the horizontal hole diameter. The horizontal holes 600*h* and the vertical holes 600*v* are arranged so as to form intersections, each intersection being of a horizontal hole 600*h* and a vertical hole 600*v*. Each horizontal hole 600*h* intersects at least one vertical hole 600*v*, and each vertical hole 600*v* intersects at least one horizontal hole 600*v*.

Figure 26:
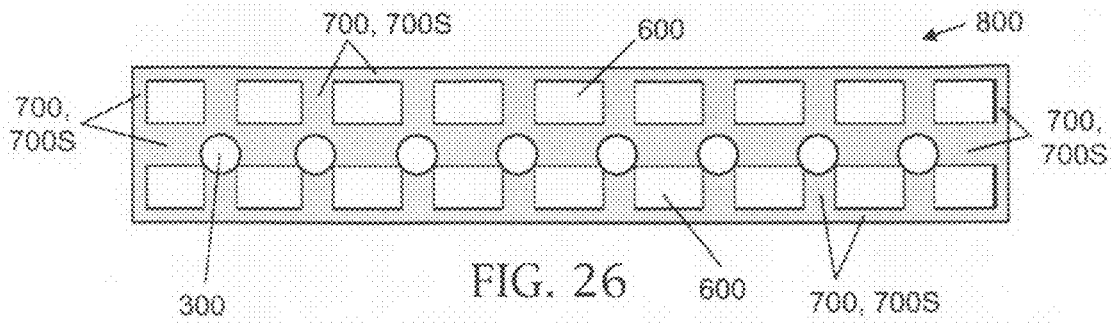
FIG. 26 is a cross-sectional plan elevation view of an inventive composite armor system embodiment that differs from the inventive composite armor system embodiment depicted in FIG. 17. The inventive composite armor systems of FIG. 17 and FIG. 26 are also made via different inventive fabrication methodologies. The inventive composite armor system shown in FIG. 26 is a product of inventive fabrication method steps including those illustrated in FIG. 22 through FIG. 26. The inventive composite armor system shown in FIG. 26 is an integrated product that includes the cross-bored metallic block, the spherical elements, and the casting, wherein the casting is both infiltrative and circumscriptive of the cross-bored metallic block and the spherical elements. The cross-sectional view of FIG. 26 is taken essentially through a geometric plane indicated by section line 26-26 in FIG. 27.
Figure 27:
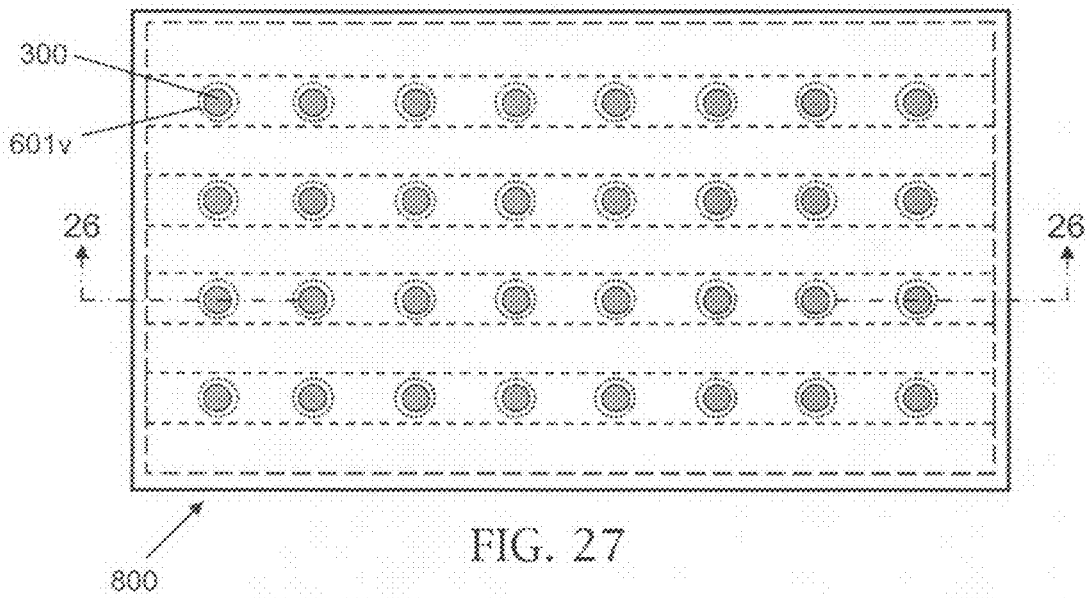
FIG. 27 is a cross-sectional plan view of the bored metallic block shown in FIG. 21 with spherical elements distributed therein such as depicted in FIG. 23. Shown in transparency are the drop-in locations upon which the spherical elements rest, one spherical element per drop-in location.

Plural spherical elements 300 are situated in the horizontal holes 600*h*. Each spherical element 300 has a spherical element diameter that is larger than the vertical hole diameter but smaller than the vertical hole diameter. Each spherical element 300 is situated at an intersection (between a horizontal hole 600*h* and a vertical hole 600*v*)—for instance rolled and/or pushed along a horizontal hole 600*h*—so as to rest upon and partially within a vertical hole 600*v*. Each intersection at which a spherical element 300 is placed is referred to herein as a "drop-in location." As shown in FIG. 26 and FIG. 27, a metallic material 700 in hot, liquid form is cast in association with the bored metallic block 600 and the spherical elements 300. According to typical inventive practice, the block 600 metallic material and the metallic material 700 are different metallic materials, the latter having a lower melting point than the former. The metallic material 700S in cooled, solidified form encompasses block 600, infiltrates horizontal holes 600*h* and vertical holes 600*v*, and sets spherical elements 300.

Figure 28:
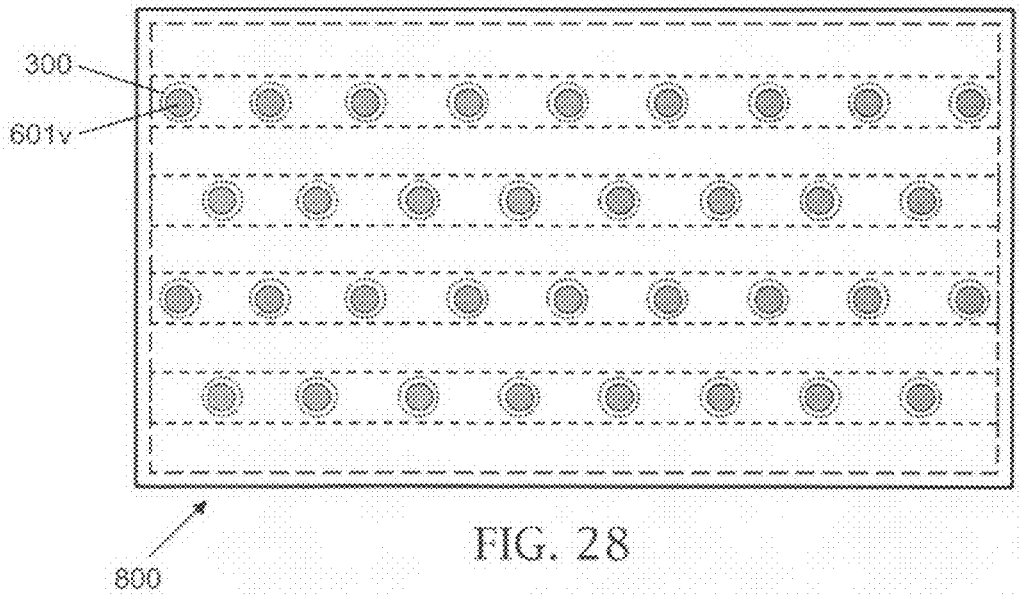
FIG. 28 is a view, similar to the view of FIG. 27, of a bored metallic block with spherical elements distributed therein such as depicted in FIG. 26. The drop-in locations portrayed in FIG. 27 are arrayed differently from the drop-in locations portrayed in FIG. 28.

The resultant composite structure is an armor device 800 such as depicted in FIG. 26 and FIG. 27. The armor device 800 shown in FIG. 28 is inventively produced similarly as the armor device 800 shown in FIG. 27. In both FIG. 27 and FIG. 28, the vertical holes 600*v* are shown to be aligned with the horizontal holes 600*v*; however, the vertical holes 600*v* are arranged differently in FIG. 27 versus FIG. 28. As shown in FIG. 27, the drop-in locations are aligned in two perpendicular directions. As shown in FIG. 28, the drop-in locations are aligned in one direction (along the horizontal channels) and are staggered in the perpendicular direction. FIG. 27 and FIG. 28 can be understood to illustrate how the mode of inventive practice illustrated in FIG. 1 through FIG. 20 can also lend itself to variation in terms of arrayal of the embedded spherical elements 300.

In inventive testing, the present inventor made a prototype inventive armor structure 800 and observed some casting voids (e.g., shrinkage porosity), in the solidified metallic material 700S. This problem may be correctable by designing more favorable configurations of blocks 600 having holes 601, such as being characterized by single-layer arrangements of the spherical elements 300. More "open" geometries of the holes 600 may also reduce propensities to casting voids. In addition, adjustments of the heating temperatures may reduce such propensities in the inventive armor product 800.

The present invention, which is disclosed herein, is not to be limited by the embodiments described or illustrated herein, which are given by way of example and not of limitation. Other embodiments of the present invention will be apparent to those skilled in the art from a consideration of the instant disclosure or from practice of the present invention. Various omissions, modifications and changes to the principles disclosed herein may be made by one skilled in the art without departing from the true scope and spirit of the present invention, which is indicated by the following claims.

What is claimed is:

1. A composite ballistic armor system comprising metallic matrix material and plural embedment elements embedded in the metallic matrix material, the metallic matrix material including a first metallic matrix material and a second metallic matrix material that differs from the first metallic matrix material, the metallic matrix material configured to include a first metallic matrix layer and a second metallic matrix layer adjacent to the first metallic matrix layer, the first metallic matrix layer constituted of the first metallic matrix material, the second metallic matrix layer constituted of the second metallic matrix material, each embedment element partially embedded in the first metallic matrix layer and partially embedded in the second metallic matrix layer, and the embedment elements non-contiguously spaced apart from each other to describe a coplanar array.

2. The composite ballistic armor system of claim 1 wherein the embedment elements are each composed of at least one material selected from the group consisting of a metallic material, a ceramic material and a polymeric material.

3. The composite ballistic armor system of claim 1 wherein each embedment element includes a ceramic core and a metallic coating.

4. The composite ballistic armor system of claim 1 wherein each embedment element is:

spherical and characterized by a diameter;

embedded in the first metallic matrix layer between approximately one-third and one-half of the diameter; and embedded in the second metallic matrix layer between approximately one-half and two-thirds of the diameter.

5. The composite ballistic armor system of claim 4 wherein the spherical embedment elements are:

approximately equal in diameter;

about equally embedded in the first metallic matrix layer and in the second metallic matrix layer; and have a composition including at least one of a ceramic material, a metallic material, and a polymeric material.

6. The composite ballistic armor system of claim 4 wherein:

the metallic matrix material is configured to include a third metallic matrix layer adjacent the second metallic matrix layer, the second metallic matrix layer situated between the first metallic matrix layer and the third metallic matrix layer, the third metallic matrix layer constituted of the first metallic matrix material.

7. The composite ballistic armor system of claim 6 wherein:

the metallic matrix material is configured to include some of the first metallic matrix material along substantially the entire periphery of the second metallic matrix layer, substantially the entire exterior of the metallic matrix material thereby formed of the first metallic matrix material.

8. The composite ballistic armor system of claim 6 wherein:

each of the embedment elements is spherical;

the third metallic matrix layer is characterized by plural truncated-spherical depressions in the exterior of the metallic matrix material, the truncated-spherical depressions corresponding to the spherical embedment elements.

9. The composite ballistic armor system of claim 8 wherein:

the metallic matrix material is configured to include first metallic matrix material along substantially the entire periphery of the second metallic matrix layer, substantially the entire exterior of the metallic matrix material thereby formed by the first metallic matrix material.

10. The composite ballistic armor system of claim 9 wherein the embedment elements are:

spherical and approximately congruent; and composed of at least one of a ceramic material and a polymeric material.

* * * * *